US009522715B1

(12) United States Patent
Gerard

(10) Patent No.: US 9,522,715 B1
(45) Date of Patent: Dec. 20, 2016

(54) STERN DEPLOYMENT AND RECOVERY ASSEMBLY FOR A SMALL CRAFT ON A LARGER VESSEL

(71) Applicant: PaR Systems, Inc., Shoreview, MN (US)

(72) Inventor: Michael Gerard, Iron Mountain, MI (US)

(73) Assignee: PAR SYSTEMS, INC., Shoreview, MN (US)

( * ) Notice: Subject to any disclaimer, the term of this patent is extended or adjusted under 35 U.S.C. 154(b) by 0 days.

(21) Appl. No.: 15/086,446

(22) Filed: Mar. 31, 2016

Related U.S. Application Data

(63) Continuation-in-part of application No. 13/657,022, filed on Oct. 22, 2012, now abandoned.

(60) Provisional application No. 61/549,228, filed on Oct. 20, 2011.

(51) Int. Cl.
*B63C 3/02* (2006.01)
*B63B 35/40* (2006.01)
*B63B 27/36* (2006.01)

(52) U.S. Cl.
CPC ..... *B63B 35/40* (2013.01); *B63C 3/02* (2013.01); *B63B 27/36* (2013.01)

(58) Field of Classification Search
CPC ..... B63C 9/22; B63C 1/12; B63C 3/02; B23B 23/30; B23B 23/32; B23B 23/34; B23B 27/36
See application file for complete search history.

(56) References Cited

U.S. PATENT DOCUMENTS

| | | | | |
|---|---|---|---|---|
| 3,472,406 | A | 10/1969 | Slipp | |
| 3,734,046 | A | 5/1973 | Schmidt et al. | |
| 4,350,112 | A | 9/1982 | Ayotte | |
| 6,637,975 | B2 | 10/2003 | Foxwell | |
| 6,779,475 | B1 | 8/2004 | Crane et al. | |
| 7,469,917 | B1 | 12/2008 | Heuiser | |
| 7,546,814 | B1 | 6/2009 | Said | |
| 7,581,507 | B2 * | 9/2009 | Kern | B63B 23/30 114/256 |
| 8,424,479 | B1 * | 4/2013 | Caccamo | B63C 3/02 114/259 |
| 2008/0202405 | A1 | 8/2008 | Kern | |

OTHER PUBLICATIONS

U.S. Patent Office issued prosecution history for U.S. Appl. No. 13/657,022, filed Oct. 22, 2012, including: Notice of Allowance issued Dec. 31, 2015, 9 pages; Final Rejection issued Mar. 11, 2015, 26 pages; and Non-Final Rejection issued Jul. 31, 2014, 12 pages; 47 pages total.

* cited by examiner

*Primary Examiner* — Andrew Polay
(74) *Attorney, Agent, or Firm* — Steven M. Koehler; Westman, Champlin & Koehler, P.A.

(57) ABSTRACT

A deployment and recovery assembly for use on a vessel that includes a tiltable ramp section mountable to a vessel to tilt into and out of the water. The ramp section is configured to support the craft. A capture and release assembly that includes a rotatable tire and wheel assembly is mounted to the ramp section to tilt therewith and is disposed on the ramp section so as to engage a hull of the craft. The capture and release assembly further includes a one-way clutch assembly coupled to the tire and wheel assembly allowing free rotation of the tire and wheel assembly in a first direction and retarding or inhibiting rotation in a second direction opposite the first direction.

20 Claims, 4 Drawing Sheets

STERN DEPLOYMENT AND RECOVERY ASSEMBLY FOR A SMALL CRAFT ON A LARGER VESSEL

CROSS REFERENCE TO RELATED APPLICATION

This application is a continuation-in-part and claims priority to U.S. patent application Ser. No. 13/657,022, filed Oct. 22, 2012; which claims the benefit of U.S. Provisional Application entitled "STERN DEPLOYMENT AND RECOVERY ASSEMBLY FOR A SMALL CRAFT ON A LARGER VESSEL" having Ser. No. 61/549,228, and filed Oct. 20, 2011, the contents of both are also incorporated herein by reference in their entirety.

BACKGROUND

Aspects of the present invention relate to the release and capture of smaller vessels such as boats from larger vessels while at sea.

It is desired by some to have a large vessel, such as but not limited to a ship, transport a smaller vessel to a desired location at which point the smaller vessel, such as but not limited to a boat, can then be deployed, perform a task, and then return back to the larger vessel for transportation and deployment at another location.

It is desired by some to have a large vessel, such as but not limited to a ship, transport a smaller vessel to a desired location at which point the smaller vessel, such as but not limited to a boat, can then be deployed, perform a task, and then return back to the larger vessel for transportation and deployment at another location.

SUMMARY

An aspect of the invention comprises a deployment and recovery assembly for use on a vessel that includes a tiltable ramp section mountable to a vessel to tilt into and out of the water. The ramp section is configured to support the craft. A capture and release assembly that includes a rotatable tire and wheel assembly is mounted to the ramp section to tilt therewith and is disposed on the ramp section so as to engage a hull of the craft. The capture and release assembly further includes a one-way clutch assembly coupled to the tire and wheel assembly allowing free rotation of the tire and wheel assembly in a first direction and retarding or inhibiting rotation in a second direction opposite the first direction.

Another aspect of the invention is a vessel having a deployment and recovery assembly as described above.

Another aspect of the invention is a method of recovering a small craft from the water. The method includes lowering a ramp section from the vessel proximate the water such that the craft engages the ramp section so as to be loaded on the vessel. The ramp section includes a capture and release assembly comprising a rotatable tire and wheel assembly mounted to the ramp section to move therewith and being disposed on the ramp section so as to engage a hull of the craft; and a one-way clutch assembly coupled to the tire and wheel assembly allowing free rotation of the tire and wheel assembly in a first direction and retarding or inhibiting rotation in a second direction opposite the first direction. The method further includes moving the craft on to the ramp so as to engage the capture and release assembly causing rotation of the tire and wheel assembly in the first direction wherein movement of the craft in a direction off the ramp due to rotation of the tire and wheel assembly in the second direction is retarded or inhibited.

Another aspect of the invention is a method of recovering a small craft from the water. The method includes lowering a ramp section from the vessel proximate the water such that the craft engages the ramp section so as to be loaded on the vessel. The ramp section includes a capture and release assembly comprising a rotatable tire and wheel assembly mounted to the ramp section to move therewith and being disposed on the ramp section so as to engage a hull of the craft; and a one-way clutch assembly coupled to the tire and wheel assembly allowing free rotation of the tire and wheel assembly in a first direction and retarding or inhibiting rotation in a second direction opposite the first direction. The method further includes moving the craft on to the ramp so as to engage the capture and release assembly causing rotation of the tire and wheel assembly in the first direction wherein movement of the craft in a direction off the ramp due to rotation of the tire and wheel assembly in the second direction is retarded or inhibited.

DETAILED DESCRIPTION OF THE ILLUSTRATIVE EMBODIMENTS

Figure 1:
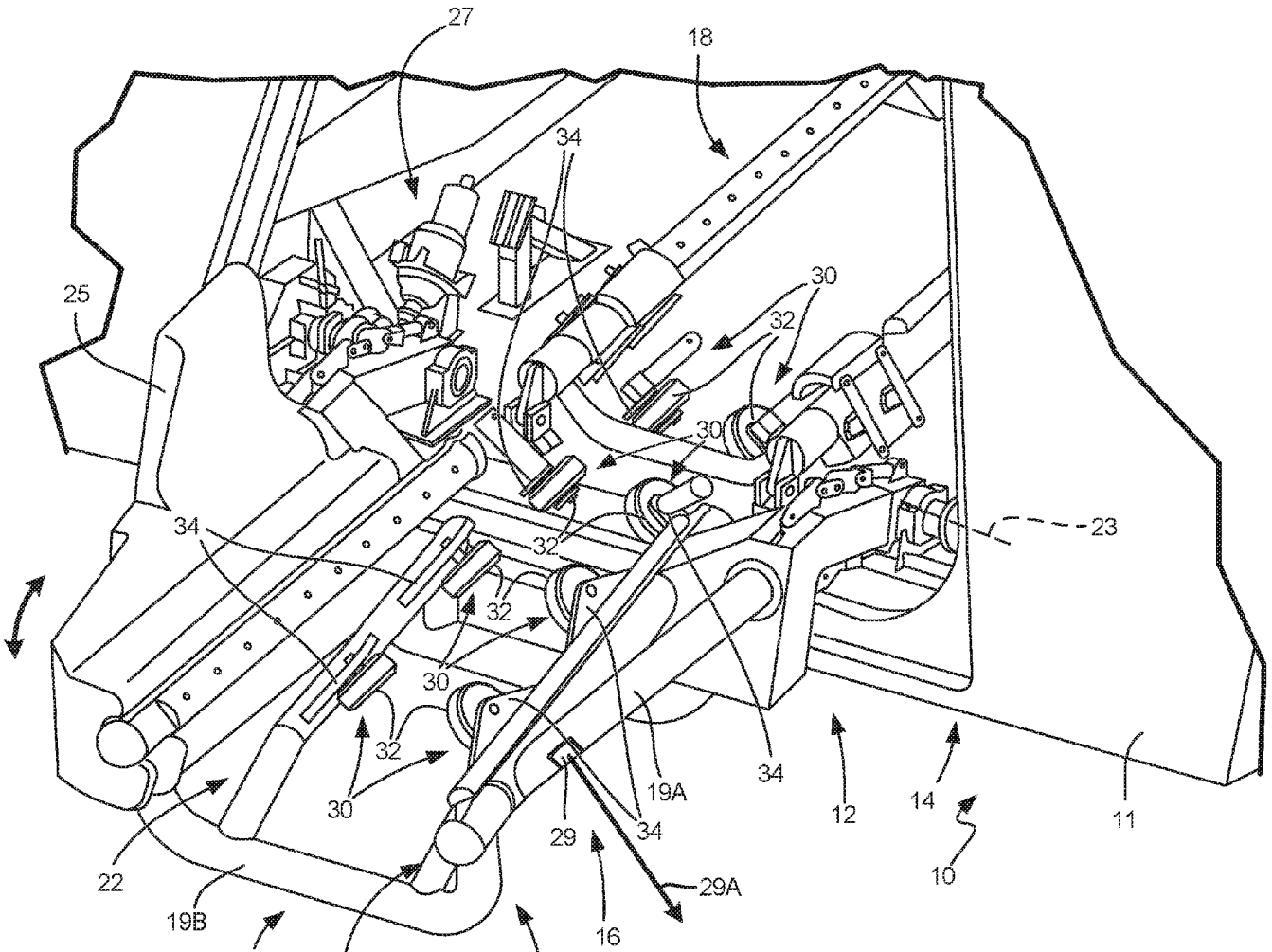
FIG. 1 is a perspective view of a stern deployment and recovery assembly with portions removed.
Figure 4:
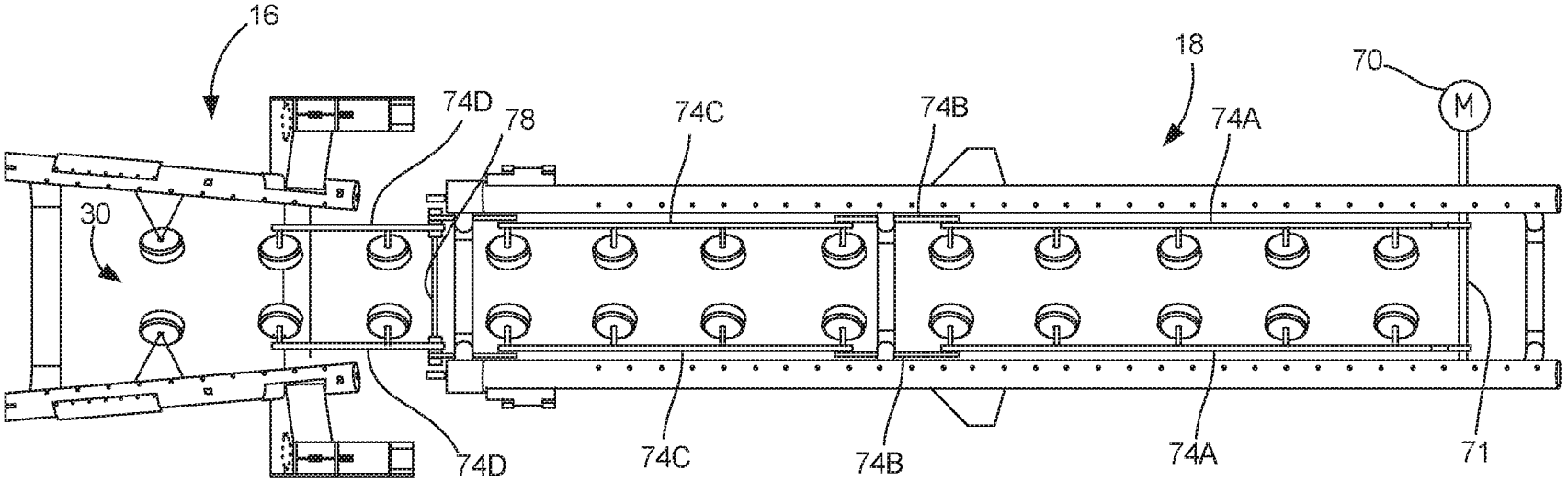
FIG. 4 is a schematic top plan view of a drive system for a plurality of capture and release assemblies.

FIG. 1 and FIG. 4 schematically illustrates a vessel such as a ship 10 having a hull 11 and a deployment and recovery assembly 12 for deploying and recovering a smaller craft (not shown). In this embodiment, the deployment and recovery assembly is arranged so as to allow deployment and recovery via the stern 14 of the vessel 10, which can have a rear door assembly not shown and not forming part of the present invention. Generally, the deployment and recovery assembly 12 includes first and second ramp sections 16, 18. The first ramp section 16 is deployable via pivoting motion from the stern 14 of the vessel 10 with the door in the open position. The ramp section 16 is configured so as to float behind the vessel 10 wherein at least a remote end 20 of the ramp section 16 is typically below the water line so that the craft to be deployed and recovered will float over the ramp section 16 as it is deployed or recovered.

The ramp section 16 includes a support structure 17 having opposed guiding structures 22 that are further apart at the remote end 20 and narrower proximate the stern 14 of the vessel 10 to guide the smaller craft off and onto the ramp section 16. In the embodiment illustrated, lateral supports 19A and 19B extend transversely between the guiding structures 22, wherein each lateral support 19A,19B is generally U-shaped so as to provide clearance for portions of the vessel such as portions of a drive unit. Structural parameters of the ramp section 16 such as its overall length, extent of deployment under the water, inclination of the guiding structures, width between and profile of the guiding structures 22, etc. vary depending upon the small craft(s) to be deployed and recovered using the ramp section 16 and the amount of clearance desired between the hull of the smaller craft and the stern 14. These parameters are configured so as to capture, align and/or lift the hull of the smaller craft above the edge 15 of the stern 14 of the vessel 10 and position the small craft so as to allow deployment and recovery through the stern 14 and onto the second ramp section 18. Float(s) can be provided on the ramp section 16. In the embodiment illustrated, a float 25 is secured to each side of the ramp section 16. In FIG. 1, one of the floats 25 has been removed in order to show other components of the ramp section 16.

The support structure 17 and hence the ramp section 16 pivots about an axis 23. A drive unit 27 having a drive motor (e.g. hydraulic, pneumatic, electric) a gear reducer, if desired, pivots (raises and lowers) the ramp section 16 about the pivot axis 23. Although illustrated wherein the ramp section 16 pivots about a fixed pivot axis 23, it should be noted that this is but one embodiment and aspects of the invention should not be considered as being limited to this type of movement. In other words, aspects of the invention can be included on other forms of ramp sections that move in a different manner such as but not limited to translation in addition to pivoting motion. The ramp section 16 includes capture and release assemblies 30, typically at least one disposed on each side of the second ramp section 16 to engage and support the small craft for transfer off and onto the second ramp section 18. One or more of the capture and release assemblies 30 are mounted to the support structure 17 so as to move therewith.

Capture and release assembly 30 includes a rotatable support element 32 herein a tire and wheel assembly. Although, in this embodiment a plurality of capture and release assemblies are depicted on each side of the ramp section 16 generally opposite each other so as to be organized in pairs, it should be understood that this should not be considered limiting. In particular, more or less capture and release assemblies 30 can be used where each capture and release assembly 30 is disposed on each side of the ramp 16 as desired. In addition capture and release assemblies 30 can be disposed at other locations along the deployment and recovery assembly 12 such as within the vessel (FIG. 4).

Figure 2:
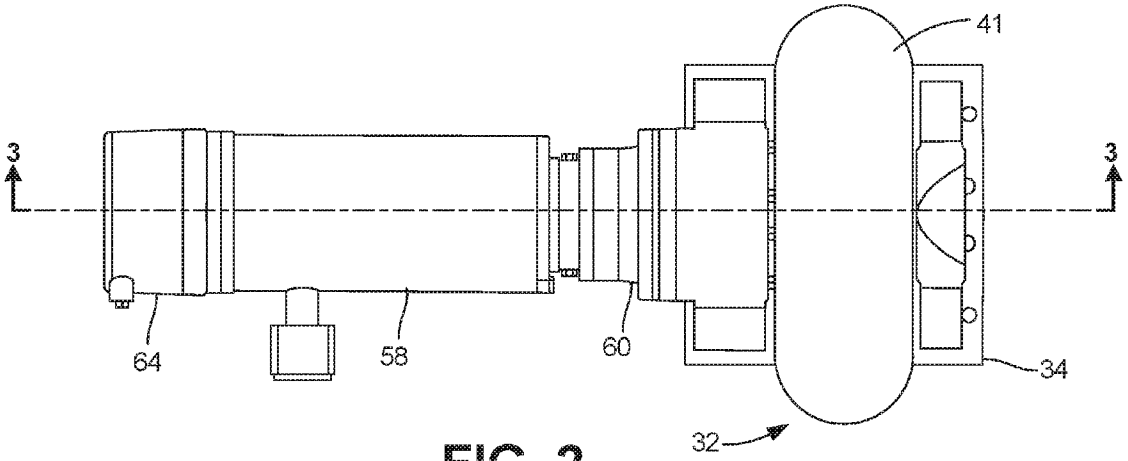
FIG. 2 is a top plan view of a capture and release assembly having a drive and a brake.
Figure 3:
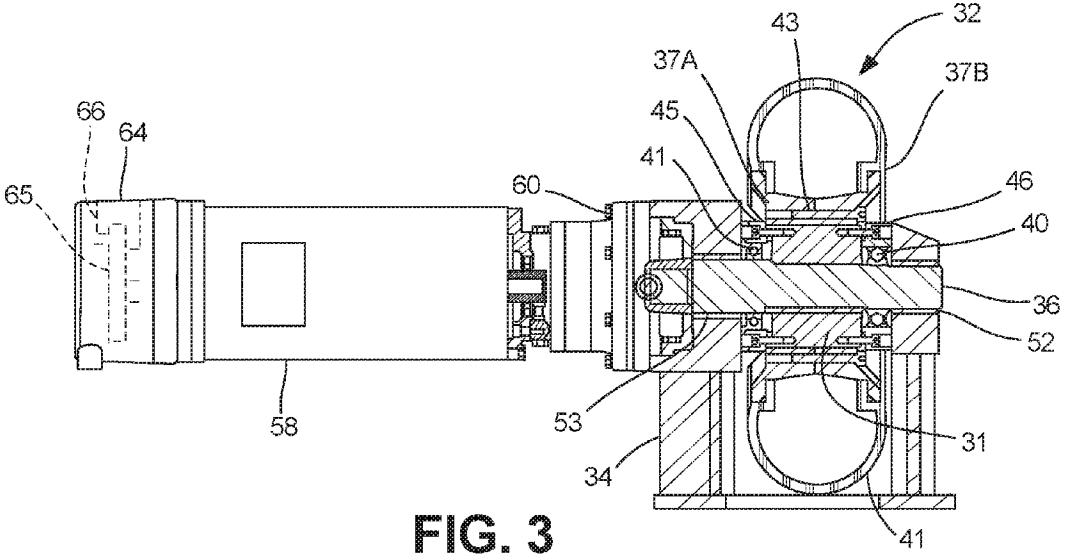
FIG. 3 is a sectional view of the capture and release assembly taken along lines 3-3 in FIG. 2.

FIGS. 2 and 3 illustrate a first embodiment of the capture and release assembly 30. In this embodiment, the capture and release assembly 30 includes a one-way clutch assembly 31 such as available from Formsprag Clutch of Warren Mich. In other words, this type of clutch allows free rotation in one direction, while retarding or inhibiting free rotation in the other direction. Such clutch assemblies are well-known and are sometimes referred to as "sprag clutch", "overrunning clutch", to name a few. As indicated above, the capture and release assembly 30 illustrated in FIGS. 2 and 3 is disposed at the stern 14 of the vessel 12 and arranged so that free rotation of the tire and wheel assembly 32 is inwardly into the vessel 10. In this manner, when the small craft engages the tire and wheel assembly 32 as it is being recovered the tire and wheel assembly will rotate freely corresponding generally to the speed of the small craft as it ascends the first ramp section 16. Upon contact with the ramp section 16, the small craft will engage the tire and wheel assemblies 32 and ride upon thereon. Once movement of the small craft on the ramp section 16 toward and possibly into the vessel 10 has stopped, the one-way clutch of the capture and release assemblies 30 engages so as to retard or inhibit rotation in the other direction which would correspond to the small craft leaving the vessel 10 (i.e. descending on the ramp section 16). In this manner, the small craft is held in position on the ramp section 16 at some point during the recovery operation, or is at least generally retarded or inhibited from exiting the vessel 10 when recovery is desired.

In the illustrative embodiment provided herein as illustrated in FIGS. 2 and 3, the capture and release assembly 30 includes a base 34 that is secured to the support structure 17 of the ramp section 16 and/or vessel 10 and supports rotation of the tire and wheel assembly 32. A wheel clutch shaft 36 is supported for rotation on base 34 with radial bearings 40 and 41 which aid in the support of radial loads of the tire and wheel assembly 32 on the wheel clutch shaft 36. Thrust bearings 45 and 46 disposed on opposite sides of the tire and wheel assembly 32 provide lateral support for forces generally parallel to the axis of rotation of the tire and wheel assembly 32. Bushings 52 and 53 provide additional support for the wheel clutch shaft 36. The one-way clutch assembly 31 is operably coupled to the wheel clutch shaft 36 and a split rim assembly 37A, 37B used to support a tire 41. It should be noted that nickel plating of various components of the capture and release assembly 30 such as the clutch, bearings, etc. is commonly desired in order to prevent corrosion in an ocean environment.

In one embodiment, it should be noted that the tire 41 on the tire wheel assembly 32 can be an aircraft tire which can support a small craft weighing approximately 19,000 pounds, while still being of a relatively compact size such as 16 inches in diameter. Of course, this is but one embodiment of a tire wherein other tires can be used if desired. It should be noted due to the relatively stiff characteristics of such tires, the split rim assembly 37 may be necessary for mounting the tire 41. An O-ring 43 is provided between the split rim halves in order to maintain an airtight seal for the pneumatic tire.

In one embodiment illustrated, the wheel clutch shaft 36 is operably coupled to a drive motor 58 (e.g. hydraulic, pneumatic or electric). A gear reducer 60 can be coupled between the drive motor 58 and the wheel clutch shaft 36, if desired. The drive motor 58 is selectively operated so as to control movement of the small craft as it is captured and/or deployed. For instance, during capture, the tire and wheel assembly 32 rotates freely as the small craft enters the ramp section 16 due to the inclusion of the one-way clutch assembly 31. Once the clutch assembly 31 has been engaged, the drive motor 58 can be operated so as to pull the small craft from the water and into the vessel 10 onto ramp section 18.

A brake 64 for inhibiting rotation of the tire and wheel assembly 32, gear reducer 60 and motor 58 can also be provided with or without the drive motor 58. Although the one-way clutch assembly 31 retards rotation in one direction, the brake 64 may be necessary to ensure that no rotation exists. In operation, brake 64 is first applied to ensure no rotation of tire and wheel assembly 32, the motor 58 and/or gear reducer 60. Engagement of the small craft with the tire and wheel assembly 32 causes free rotation of the tire and wheel assembly 32 until counter rotation is about to begin at which point the one-way clutch assembly 31 engages and the brake 64 holds the small craft stationary. The brake 64 can take any number of forms but generally involves inhibiting rotation of the tire and wheel assembly 32. For instance, the brake 64 can include surfaces that selectively engage each other. In FIG. 2 a caliper 65 selectively engages a disk 65, but this is just one exemplary form. Although the brake 64 is illustrated in FIG. 2 as being external to the tire and wheel assembly 32 as appreciated by those skilled in the art, a brake mechanism can also be disposed within the tire and wheel assembly 32. As also appreciated by those skilled in the art, operation of the brake (e.g. operation of the caliper 66) can take any number of forms including a direct connection such as via cable or linkage. In addition, the caliper can include an actuator (hydraulic, pneumatic or electric) with a suitable control device to operate the actuator.

Instead of individual motors for each powered capture and release assembly 30, FIG. 4 illustrates a common drive 70 (electric, hydraulic or pneumatic motor) for a plurality of capture and drive assemblies 30. In the embodiment illustrated, drive 70 is connected to a common shaft 71 that in turn is driveably connected to a plurality of capture and release assemblies 30 on each side of ramp section 16 and 18. As illustrated one or more elongated loop elements (e.g. belts, chains, etc.) 74A, 74B, 74C and 74D are operably coupled to the capture and release assemblies 30 and to each other so as to drive or control the capture and release assemblies as described above. (It should be noted ramp section 16 can pivot about shaft 78.) The capture and release assemblies 30 can be constructed in a manner similar to that described in FIGS. 2 and 3, where the motor 58 is replaced with a suitable element (e.g. pulley, gear, etc.) to operate with the loop elements 74A-74D being employed. If necessary, the gear reducer 60 and/or brake 64 can be employed individually at each capture and release assemblies 30, at only some capture and release assemblies 30, or at the drive 70. As illustrated in FIG. 4, the capture and release assemblies on the ramp section 16 are not connected to the drive 70, but can include only the brake 64 that is selectively applied as discussed above during recovery of the small craft to allow rotation of the tire and wheel assemblies 32 in a direction toward the vessel 10 via the one-way clutch assembly 31, but retards or inhibits counter rotation during recovery thereby preventing the small craft from at least easily descending the ramp section 16 away from the vessel 10.

If desired, the second ramp section 18 can pivot about the pivot axis proximate the stern 14 and/or capture and release assembly 32. Thereby allowing ramp rails of the ramp section 18 to pivot upwardly upon engagement of the small craft with the ramp section 18 which can help inhibit forward motion of the small craft during recovery. A suitable lift mechanism such as an actuator (electric, pneumatic, hydraulic), chains, cables, levers, etc. is/are operably coupled to selectively tilt the ramp section 18.

During deployment of the small craft, the second section 18 can be pivotable about an axis proximate the ramp section 16 which enables the ramp section 18 to lift the small craft to an inclined position. Rather than letting the small craft unpredictably slide down the ramp section 18, the ramp section 18 can be inclined to a position where static friction would be overcome; however, one or more of the capture and release assemblies 30 with corresponding engagement of the tire 41 upon the hull of the small craft retards or inhibits downward movement of the small craft upon the ramp section 18. Commonly, the brake(s) 64 would be activated to inhibit rotation of the tire and wheel assemblies 32. When desired, the brake(s) can be released (if it has been previously actuated) and the drive motor(s) 58 or common drive 70 can be operated in a controlled manner so as to drive the one-way clutch assembly 31 in a manner so as to deploy the small craft from the vessel 10 and onto capture and release assemblies 30 on the first ramp section 16 and, from there out to sea.

During recovery of the small craft, the small craft contacts the capture and release assemblies 30 on the ramp section 16. In one embodiment as illustrated in FIG. 4, forward movement of the small craft on the ramp section 16 eventually causes contact of the small craft with the powered capture and release assemblies 30. The tire and wheel assemblies 32 of the powered capture and release assemblies 30 would be driven so as to pull the small craft into the vessel 10; however, each of the tire and wheel assemblies 32 illustrated have the ability to free wheel with a rotation into the vessel 10 via the one way sprag type clutch. This allows smooth unrestricted motion of the small craft on ramp section 16 during a powered entry yet have a locking feature (brake 64) in the event the small craft tries to slide backward on the ramp section 16.

It has been found that the angle of inclination of the support structure 17 can be important in efficiently launching and retrieving the small craft. In addition, the optimum angle of inclination for launching and recovery can vary from craft to craft. In one embodiment, a sensor 29 is provided on the ramp section 16 to measure the angle of inclination (e.g. relative to smooth or flat surface of the water and/or a portion of the vessel 10). The sensor 29 directly measures the angle of inclination as opposed to ascertaining the angle of inclination through monitoring operation of the drive 27. Typically, the drive 27 includes additional gearing so that ramp section 16 moves in a relative slow manner. However, the gearing introduces error, through for example backlash between the gears, which may not allow precise compensation to be ascertained. It has been found that very small changes in the angle of inclination, for example, on the order of one-two degrees can affect how efficiently the small craft is launched and/or recovered.

Figure 5:
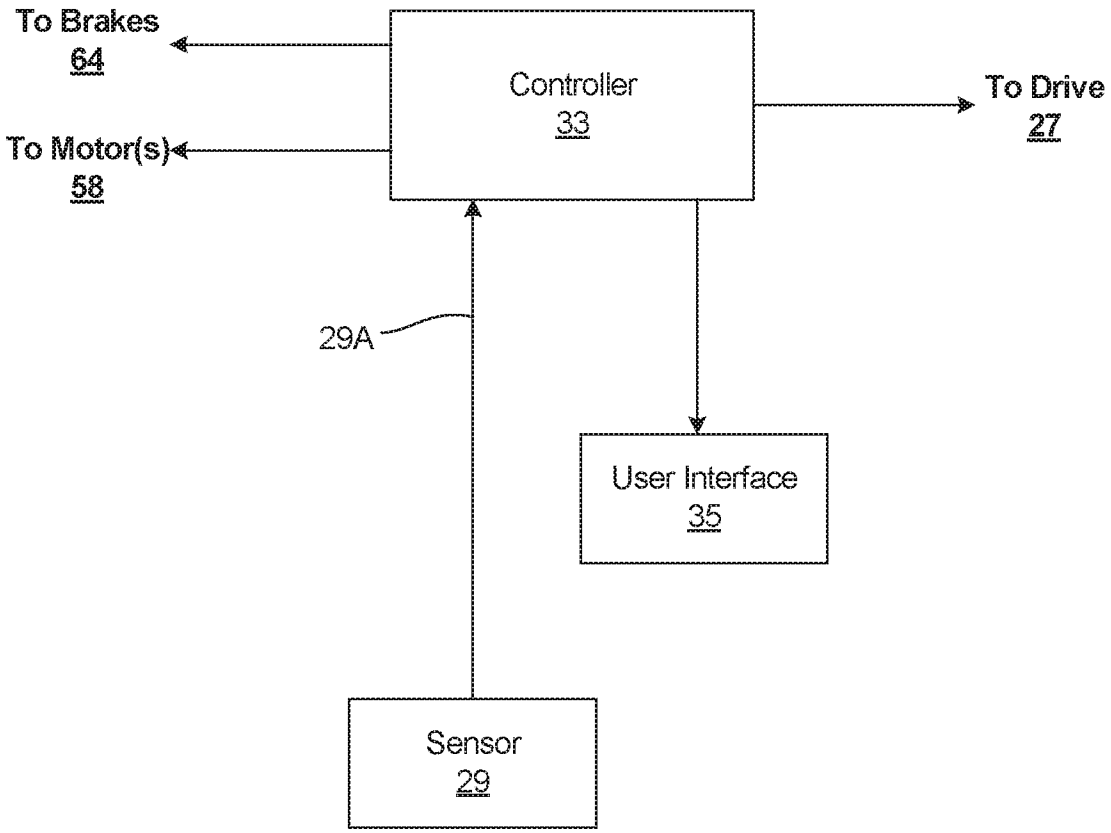
FIG. 5 is a schematic diagram of a controller.

In one embodiment, sensor 29 comprises an inclinometer 29 that is mounted to the ramp section 16 (FIG. 1) in any convenient location such as to a component of the guiding structure 22 or lateral supports 19A, 19B so as to directly measure the angle of inclination and provide a corresponding output signal 29A (wired or wireless) to a controller 33 illustrated in FIG. 5. The controller 33 includes a user interface 35 such as but not limited to a touch screen that allows a user to control the movement of the ramp section 16 via control signal(s) to the drive 27 (as well as drive signal(s) 58A to each motor 58 and control signal(s) to each brake 64 when needed).

In one mode of operation, the user interface 35 provides input(s) to controller 33 indicating launching or recovery of the small craft. The controller 33 operates drive 27 so as to obtain the desired angle of inclination based on the output received from sensor 29.

In yet a further embodiment, the user interface 35 receives input(s) indicative of a desired angle of inclination based on, for example, type, size, model, etc. of small craft that is going to be launched or recovered. Although the angle of inclination for each small craft can be entered via the user interface 35, in another embodiment, the controller 33 can access a predetermined value for the angle of inclination based on for example, type, size, model, etc. of small craft, which for example, is stored in memory of, or accessible to, the controller 33. In this manner, the user need not know the actual value of the angle of inclination, but rather only which small craft is being launched or recovered. The controller 33 then operates drive 27 so as to obtain the predetermined angle of inclination based on the specific small craft being launched or recovered. The controller 33 can include a microprocessor, storage media, analog and/or digital processing circuitry. The controller 27 can be a standalone or dedicated device or be used to control other aspects of the vessel 10.

Although the subject matter has been described in language specific to structural features and/or methodological acts, it is to be understood that the subject matter defined in the appended claims is not necessarily limited to the specific features or acts described above as has been held by the courts. Rather, the specific features and acts described above are disclosed as example forms of implementing the claims.

What is claimed is:

1. A deployment and recovery assembly for use on a vessel comprising:

a tiltable ramp section configured to support a craft and mountable to a vessel to tilt into and out of water; and a capture and release assembly mountable to at least one of the ramp section or to the vessel in front of the ramp section to engage a hull of the craft when the craft is present on the ramp section, the capture and release assembly comprising:

a shaft supported by a base;

a rotatable tire and wheel assembly configured to engage a hull of the craft when the craft is present on the ramp section, the rotatable tire and wheel assembly rotatable in a first direction to move the craft toward the vessel and rotatable in a second direction to move the craft away from the vessel;

a shaft brake coupled to the shaft and configured to selectively inhibit rotation of the shaft in the first and second directions; and a one-way clutch coupling the shaft to the tire and wheel assembly and configured to allow free rotation of the tire and wheel assembly in the first direction and inhibiting rotation in the second direction when the brake is inhibiting rotation of the shaft in the first and second directions.

2. The deployment and recovery assembly of claim 1 wherein the one-way clutch is configured such that the first direction is into the vessel.

3. The deployment and recovery assembly of claim 1 wherein the capture and release assembly comprises:

a plurality of spaced apart shafts supported by corresponding bases;

a plurality of shaft brakes, each shaft brake coupled to one of the shafts and configured to selectively inhibit rotation of the corresponding shaft connected thereto in the first and second directions; and a plurality of rotatable tire and wheel assemblies and a plurality of one-way clutches, each rotatable tire and wheel assembly rotatable in the first direction to move the craft toward the vessel and rotatable in the second direction to move the craft away from the vessel, and each one-way clutch coupling one of the rotatable tire and wheel assemblies to one of the shafts, each one-way clutch configured to allow free rotation of the corresponding tire and wheel assembly connected thereto in the first direction and inhibiting rotation in the second direction when the corresponding shaft brake is inhibiting rotation of the corresponding shaft in the first and second directions.

4. The deployment and recovery assembly of claim 1 wherein the capture and release assembly further comprises a second shaft supported by a second base;

a second rotatable tire and wheel assembly configured to engage the hull of the craft on a side opposite the rotatable tire and wheel assembly when the craft is present on the ramp, the second rotatable tire and wheel assembly rotatable in the first direction to move the craft toward the vessel and rotatable in the second direction to move the craft away from the vessel;

a second shaft brake coupled to the second shaft and configured to selectively inhibit rotation of the second shaft in the first and second directions; and a second one-way clutch coupling the second tire and wheel assembly to the second shaft and configured to allow free rotation of the tire and wheel assembly in the first direction and inhibiting rotation in the second direction when the brake is inhibiting rotation of the shaft in the first and second directions.

5. The deployment and recovery assembly of claim 1 wherein the capture and release assembly further comprises at least one drive motor operably coupled to the tire and wheel assembly.

6. The deployment and recovery assembly of claim 1 and further comprising:

a sensor operably mounted to the tiltable ramp section to directly measure an angle of inclination of the tiltable ramp section and provide an output signal.

7. The deployment and recovery assembly of claim 6 and further comprising:

a drive coupled to the tiltable ramp section configured to tilt the tiltable ramp;

a controller operable coupled to the drive and the sensor; and a user interface configured to receive an input indicative of a desired angle of inclination of the tiltable ramp section.

8. A vessel configured to recover a small craft from the water, the vessel comprising:

a hull; and a deployment and recovery assembly comprising:

a tiltable ramp section mounted to the vessel to tilt into and out of water; and a capture and release assembly mounted to at least one of the ramp section or to the vessel in front of the ramp section to engage a hull of the craft when the craft is present on the ramp section, the capture and release assembly comprising:

a shaft supported by a base;

a rotatable tire and wheel assembly configured to engage a hull of the craft when the craft is present on the ramp, the rotatable tire and wheel assembly rotatable in a first direction to move the craft toward the vessel and rotatable in a second direction to move the craft away from the vessel;

a shaft brake coupled to the shaft and configured to selectively inhibit rotation of the shaft in the first and second directions; and a one-way clutch coupling the shaft to the tire and wheel assembly allowing free rotation of the tire and wheel assembly in the first direction and inhibiting rotation in the second direction when the brake is inhibiting rotation of the shaft in the first and second directions.

9. The vessel of claim 8 wherein each one-way clutch is configured such that the first direction is into the vessel.

10. The vessel of claim 8 wherein at least two capture and release assemblies are mounted to the vessel to engage opposite sides of a hull of a craft.

11. The vessel of claim 8 wherein the vessel has a stern and the tiltable ramp section is configured to pivot over the stern.

12. The vessel of claim 8 wherein the capture and release assembly further comprises a drive motor operably coupled to at least one of the tire and wheel assembly.

13. The vessel of claim 8 wherein the capture and release assembly further comprises:

a second shaft supported by a second base;

a second rotatable tire and wheel assembly configured to engage the hull of the craft on a side opposite the rotatable tire and wheel assembly when the craft is present on the ramp, the second rotatable tire and wheel assembly rotatable in the first direction to move the craft toward the vessel and rotatable in the second direction to move the craft away from the vessel;

a second shaft brake coupled to the second shaft and configured to selectively inhibit rotation of the second shaft in the first and second directions; and a second one-way clutch coupling the second tire and wheel assembly to the second shaft and configured to allow free rotation of the tire and wheel assembly in the first direction and inhibiting rotation in the second direction when the brake is inhibiting rotation of the shaft in the first and second directions.

14. The vessel of claim 8 wherein the capture and release assembly comprises:

a plurality of spaced apart shafts supported by corresponding bases;

a plurality of shaft brakes, each shaft brake coupled to one of the shafts and configured to selectively inhibit rotation of the corresponding shaft connected thereto in the first and second directions; and a plurality of rotatable tire and wheel assemblies and a plurality of one-way clutches, each rotatable tire and wheel assembly rotatable in the first direction to move the craft toward the vessel and rotatable in the second direction to move the craft away from the vessel, and each one-way clutch coupling one of the rotatable tire and wheel assemblies to one of the shafts, each one-way clutch configured to allow free rotation of the corresponding tire and wheel assembly connected thereto in the first direction and inhibiting rotation in the second direction when the corresponding shaft brake is inhibiting rotation of the corresponding shaft in the first and second directions.

15. A method of recovering a small craft from water, the method comprising:

lowering a ramp section from a vessel proximate the water such that the craft engages the ramp section so as to be loaded on the vessel, the ramp operable with a capture and release assembly having a rotatable tire and wheel assembly positioned to engage a hull of the craft, a motor coupled to the tire and wheel assembly through a shaft, a one-way clutch coupling the tire and wheel assembly to the shaft and a shaft brake to inhibit rotation of the shaft;

operating the shaft brake to inhibit rotation of the shaft in directions off of and onto the vessel and so that rotation of the tire and wheel assembly is inhibited in the direction off of the vessel;

subsequent to the application of the brake, engaging the hull of the craft with the tire and wheel assembly so that the tire and wheel assembly is rotated in the direction to load the craft on the vessel, the one-way clutch and application of the brake inhibiting rotation of the tire and wheel assembly in the direction for unloading the craft off of the vessel;

allowing the craft to come to a stop due to the inhibited rotation of the tire and wheel assembly in the direction for the craft to be unloaded off of the vessel; and after the craft has come to a stop, releasing the brake to allow rotation of the shaft and operating the motor to rotate the shaft and the tire and wheel assembly to move the craft on the ramp in the direction to load the craft onto the vessel.

16. The method of claim 15 wherein the vessel has a stern and wherein lowering comprises pivoting over the stern.

17. The method of claim 16 wherein lowering the ramp section comprises directly measuring an angle of inclination of the ramp section and lowering the ramp section until a desired angle of inclination is obtained.

18. The method of claim 17 and further comprising ascertaining the desired angle of inclination based on an input related to a small craft that is being launched or recovered via the ramp section.

19. The method of claim 15 wherein the capture and release assembly further comprises a drive motor operably coupled to the tire and wheel assembly, and the method further comprising operating the drive motor to drive the tire and wheel assembly and move the craft from the ramp section and into the vessel.

20. A deployment and recovery assembly for use on a vessel comprising:

a tiltable ramp section mountable to a vessel to tilt into and out of water, the ramp section having opposed guiding structures configured to guide the craft; and a capture and release assembly mountable to at least one of the ramp section or to the vessel in front of the ramp section to engage a hull of the craft when the craft is present on the ramp section, the capture and release assembly comprising:

a shaft supported by a base;

a rotatable tire and wheel assembly configured to engage a hull of the craft when the craft is present on the ramp, the rotatable tire and wheel assembly rotatable in a first direction to move the craft toward the vessel and rotatable in a second direction to move the craft away from the vessel; and a shaft brake coupled to the shaft and configured to selectively inhibit rotation of the shaft in the first and second directions;

a one-way clutch coupling the shaft to the tire and wheel assembly and configured to allow free rotation of the tire and wheel assembly if rotated in a first direction and inhibiting rotation the second direction when the brake is inhibiting rotation of the shaft in the first and second directions.

* * * * *